US007232051B2

(12) United States Patent
Huang et al.

(10) Patent No.: US 7,232,051 B2
(45) Date of Patent: Jun. 19, 2007

(54) NAIL TRAY HOIST STRUCTURE FOR A COIL NAILER

(75) Inventors: Leo Huang, Taichung (TW); Sam Yu, Taichung (TW); Blackey Tsai, Taichung (TW)

(73) Assignee: Basso Industry Corp., Taichung (TW)

( * ) Notice: Subject to any disclaimer, the term of this patent is extended or adjusted under 35 U.S.C. 154(b) by 0 days.

(21) Appl. No.: 11/254,970

(22) Filed: Oct. 21, 2005

(65) Prior Publication Data

US 2007/0090147 A1 Apr. 26, 2007

(51) Int. Cl.
*B25C 5/02* (2006.01)

(52) U.S. Cl. ..... 227/120; 227/128; 227/109; 227/119; 227/130; 227/136

(58) Field of Classification Search ..... 227/120, 227/128, 135–137, 109, 119, 130
See application file for complete search history.

(56) References Cited

U.S. PATENT DOCUMENTS 3,568,908 A * 3/1971 Bader ..... 227/127
4,518,109 A * 5/1985 Shiroyama ..... 227/109
4,600,135 A * 7/1986 Mukoyama ..... 227/120
5,634,582 A * 6/1997 Morrison et al. ..... 227/109
5,683,024 A * 11/1997 Eminger et al. ..... 227/8
6,152,346 A * 11/2000 Laubach ..... 227/109
6,957,757 B1 * 10/2005 Huang ..... 227/137
7,048,170 B2 * 5/2006 Lin ..... 227/137

* cited by examiner

*Primary Examiner*—John Sipos
*Assistant Examiner*—Michelle Lopez
(74) *Attorney, Agent, or Firm*—Egbert Law Offices

(57) ABSTRACT

The nail tray hoist structure for coil nailer includes: several positioning slots spaced through out the side wall of the central column of the coil nailer base; a positioning through hole, placed on the vertical sleeve of the nail tray; a positioning body, placed in the positioning through hole actively; a braking tube, placed on the outside of the vertical sleeve; and an upper elastic component, having a top blocked by the limit component used by the vertical sleeve. The bottom of the elastic component stops the balance block of the braking tube, so that it can push down the braking tube. By so doing, the hoist structure of the nail tray only needs pushing and pulling movements on the braking tube, which gives the users more convenience and ensures the strength of the structure.

6 Claims, 11 Drawing Sheets

NAIL TRAY HOIST STRUCTURE FOR A COIL NAILER

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a coil nailer, and more particularly to a new nail tray hoist structure for a coil nailer.

BACKGROUND OF THE INVENTION

The nail row that is used on the coil nailer is placed in the coil nailer base preserved in the body, and there is a nail tray inside the coil nailer base for the nail tray. Because there is a difference in length when the nail row is used, the industry makes the nail tray move up and down. Therefore, the objective of the present invention is to make the hoist structure of the nail tray adjustable and improve the positioning structure.

The conventional hoist structure of the nail tray mentioned above is shown in FIG. 1, and it places a horizontal through space 12 in the central column 11 of the coil nailer base 10, and places a positioning groove 13 in the upper and lower space in the through space. Moreover, a horizontal positioning button 20 is made, and a press-control end 21 protrudes out of the through hole 32 corresponding to the central protruding tube 31 of the nail tray 30. A wedge 22 in the middle of the positioning button 20 can be locked in the positioning groove 13 mentioned above, and on the other end of the positioning button 20 has an axial peg 23 that goes through the axial hole 33 on the other side of central protruding tube 31. The outside of the axial peg 23 has a spring 24 for the wedge 22 of the positioning button 20 pushing towards the direction of positioning groove 13, and by so doing positioning the nail tray. When the conventional structure needs to adjust the height of the nail tray 30 as shown in FIG. 2, it must press the press-control end 21 of the positioning button 20 inward, and further makes the wedge 22 come off the positioning groove 13, and in so doing to release nail tray 22 to achieve the purpose of going up and down. The following issues still exist in the conventional structure in practical use.

1. So as to assemble the positioning button 20, the central column 11 of the coil nailer base 10 must form the horizontal through space 12 that is empty inside, because by doing so, the material of the column becomes thin, which obviously weakens the structure of the central column 11, and affects the endurance.

2. So as to avoid being bumped by the nail row, the press-control end 21 of the positioning button 20 does not have sufficient length, therefore, it takes much effort when pressing the press-control end 21, and further causes the inconvenience.

Thus, to overcome the aforementioned problems of the prior art, it would be an advancement in the art to provide an improved nail tray hoist structure for a coil nailer with an innovative structure.

BRIEF SUMMARY OF THE INVENTION

The improvements of the present invention are as follows:

Conventional Technology: (Please See Description of the Prior Art)

1. The central column of the coil nailer base must form a horizontal through space that is empty inside, because by doing so, the material of the column becomes thin, which obviously weakens the structure of the central column and affects the endurance.

2. When operating the hoist structure of the nail tray, it may press a horizontal positioning button, except that the press-control end of the positioning button does not have sufficient length, therefore, it takes much effort when pressing the press-control end 21, and further causes the inconvenience.

The present invention:

1. The side wall of the central column 41 of the present invention only needs to have a positioning body (positioning bead 60 disclosed in the embodiment) that is deep enough to lock in to half of the positioning slot 42, therefore, the strength of the structure of the central column 41 may be reduced to the minimum, so that the central column can be more durable.

2. When conducting the hoist structure of the nail tray, it can be achieved by pulling the braking tube 70, so that it may be more effective and practical.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

The features and the advantages of the present invention will be more readily understood upon a thoughtful deliberation of the following detailed description of a preferred embodiment of the present invention with reference to the accompanying drawings.

As shown in FIGS. 3–10, the embodiment of the hoist structure of the nail tray of the coil nailer of the present invention is for description only, it is not limited to this structure on the patent application.

Figure 1:
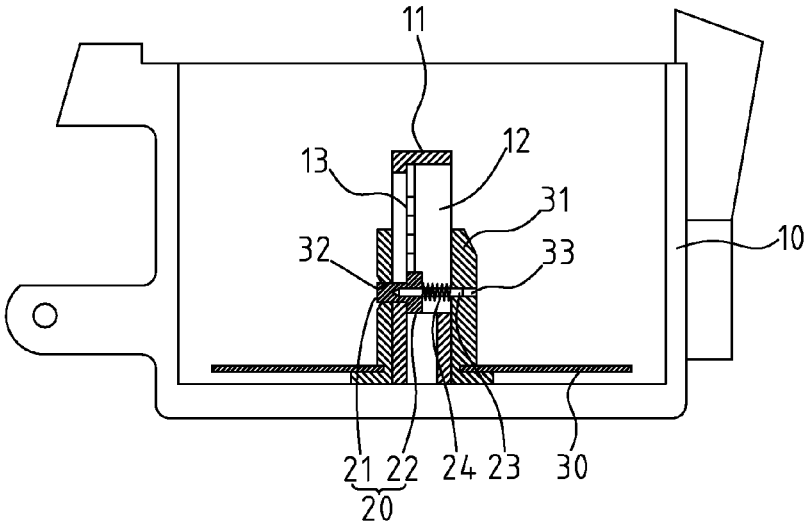
FIG.1 PRIOR ART
FIG. 1 shows a sectional view of the conventional structure.
Figure 2:
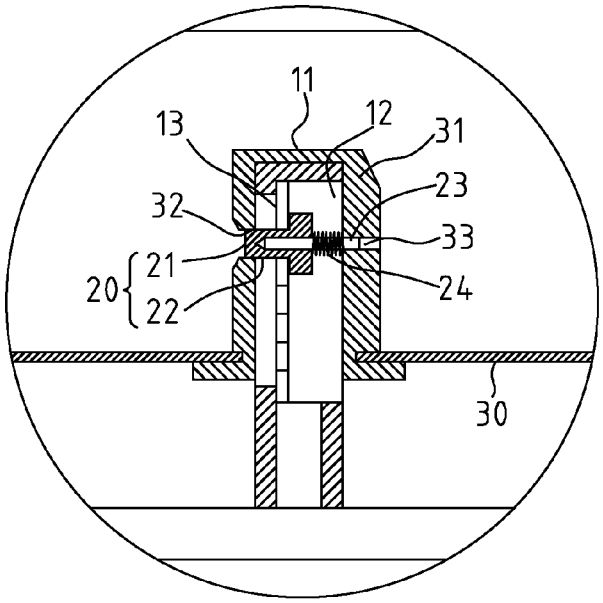
FIG.2 PRIOR ART
FIG. 2 shows an operating perspective view of the conventional structure.
Figure 3:
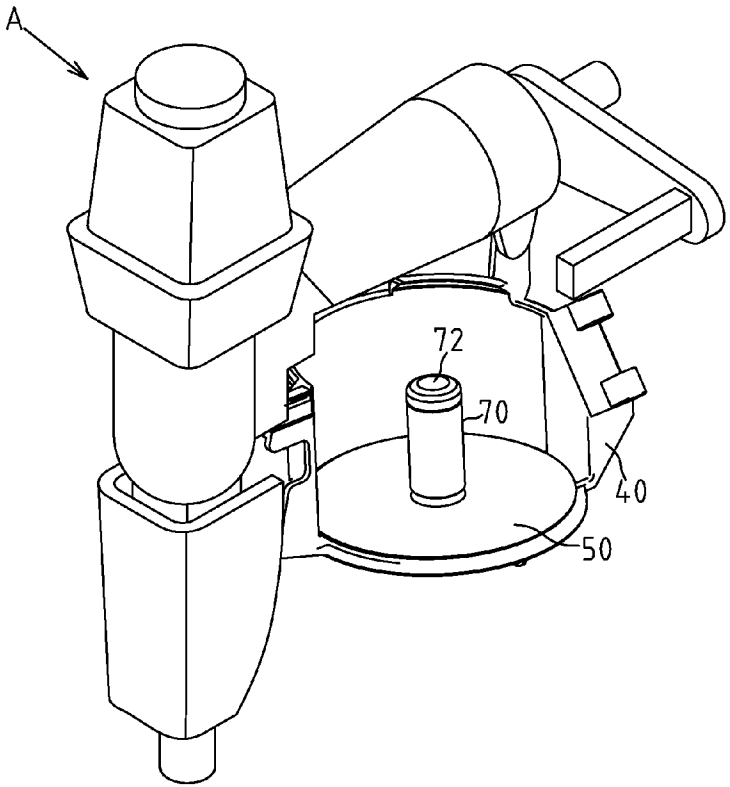
FIG. 3 shows a perspective view of the location of the coil nailer that has the up and down structure of the nail tray of the present invention assembled on it.
Figure 4:
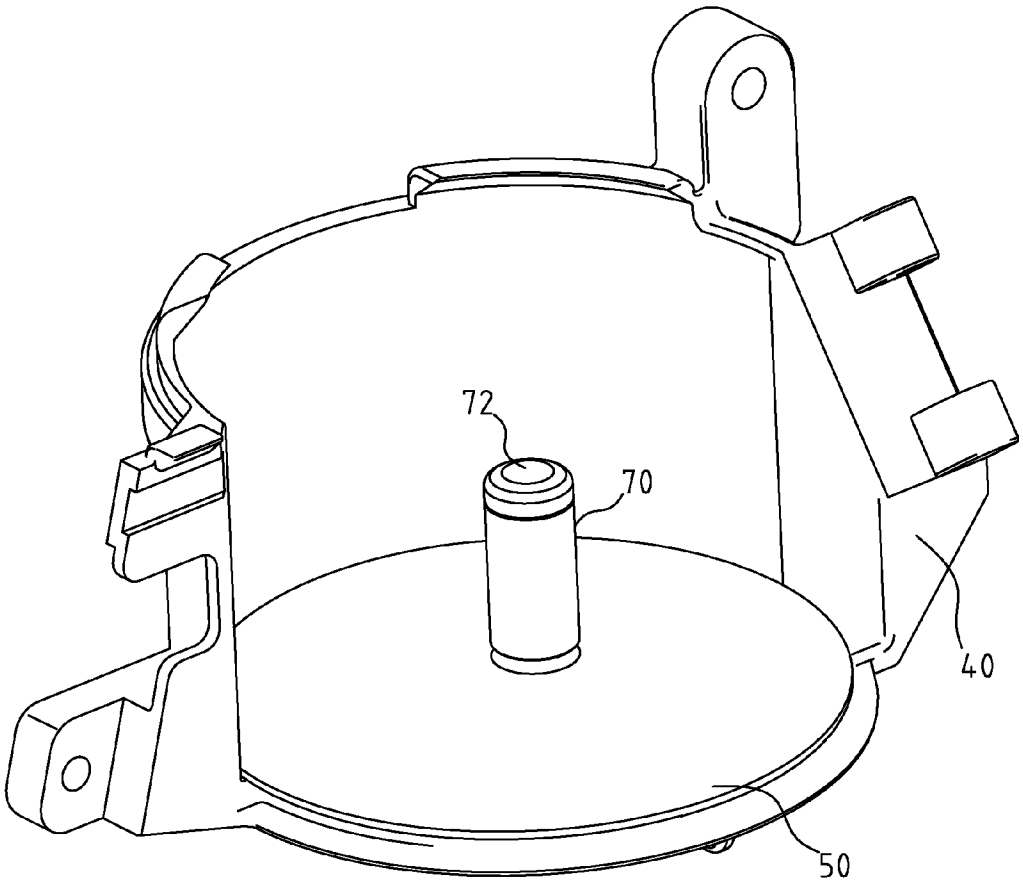
FIG. 4 shows an enlarged perspective view of the hoist structure position of the nail tray of the FIG. 3.
Figure 5:
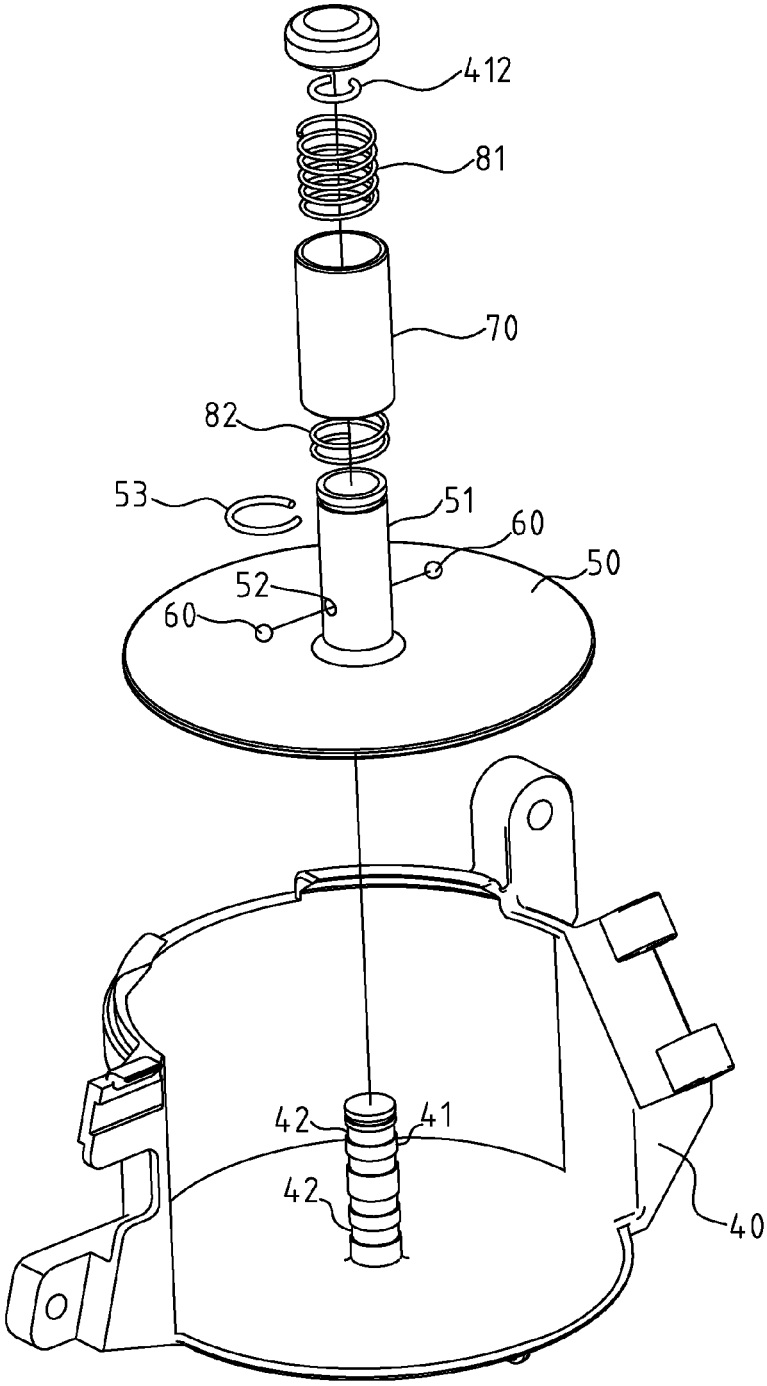
FIG. 5 shows an exploded view of the hoist structure position of the nail tray of the present invention.

First, as shown in FIGS. 3, 4, and 5, is the preferred embodiment of the hoist structure of the nail tray for the coil nailer of the present invention. The hoist structure is placed in the central column 41 of the coil nailer base 40 of the coil nailer A where it corresponds to the vertical sleeve 51 of the nail tray 50. Among them, the vertical sleeve 51 of the nail tray 50 is placed on the outside of the central column 41, which slides toward the axle along the central column, and a buckle 412 is placed on top of the central column 41. The nailer tray hoist structure of the present invention comprises the following.

There are several positioning slots 42 on both sides of the central column 41 of the coil nailer base 40.

Two positioning through holes 52 are placed on two sides of the column wall of the vertical sleeve 51 of the nail tray 50, going through horizontally.

The invention has a positioning body, the embodiment of the present invention adopting two positioning beads 60, which can be placed in the positioning through hole 51 mentioned above in a movable state.

A braking tube 70 is placed on the outside of the vertical sleeve 51 of the nail tray 50, which slides towards the vertical sleeve, and the inner wall of the braking tube 70 has balance block 70 (It is a ring like protruding edge in this embodiment). When the balance block of the braking tube 70 reaches the dead-center, it will stand correspondingly with the positioning through hole 52 of the vertical sleeve 51 of the nail tray 50, and further moves the positioning bead 60 inward.

An elastic component 81 is a spring in this embodiment, and it is placed between the top of the braking tube 70 and the top of the vertical sleeve 51 of the nail tray 50. The top of the elastic component 81 has been blocked by a limit component 53 on top of the vertical sleeve 51, and the bottom of the upper elastic component 81 stops on the top of the balance block 71 of the braking tube 70, and by so doing pushes the braking tube 70 down, so that it is at the dead-center.

A lower elastic component 82 is a spring in this embodiment, and it is placed between the bottom of the balance block 71 of the braking tube 70 and the nail tray 50 to push the braking tube 70 upward elastically, and to create a balance effect with the elastic component 82 mentioned above, so that the braking tube 70 stays on the designated height.

Among them, the limit component 53 placed on top of the vertical sleeve 51 can be a buckle.

Among them, the top of the braking tube 70 can be sealed by a casing 72.

Through the above structure and design, the operation of the present invention disclosed by the present is explained as follows.

Figure 6:
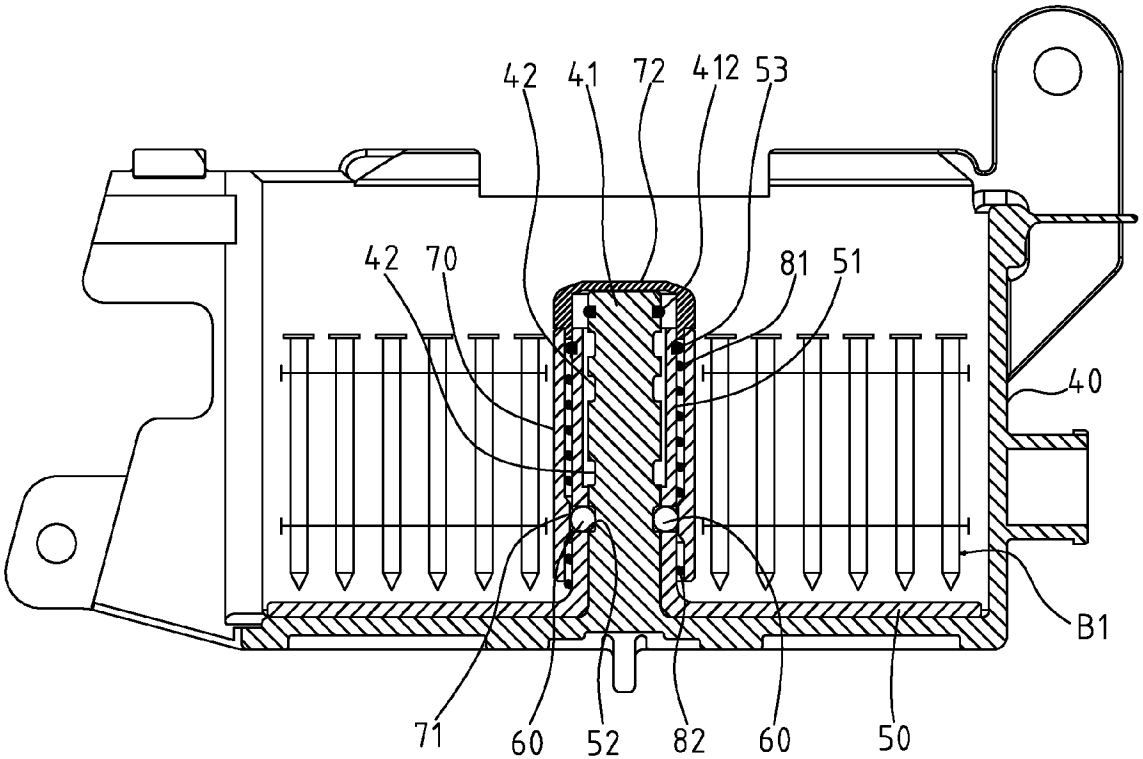
FIG. 6 shows a sectional view of the hoist structure position of the nail tray of the present invention.

As shown in FIG. 6, which is the lowest gear of the nail tray 50, the nail tray 50 can be placed with nail coil B1 that is larger and longer. In addition, the braking tube 70 is pushed down by the upper elastic component 81 to the pre-designed dead-center, which causes the balance block 71 stand correspondingly to the positioning through hole 52 of the vertical sleeve 51 of the nail tray 50, and further pushes the positioning bead 60 inward and be locked in to the positioning slot 42 of the central column 41 of the coil nailer base 40, and by so doing positions the nail tray 50.

Figure 7:
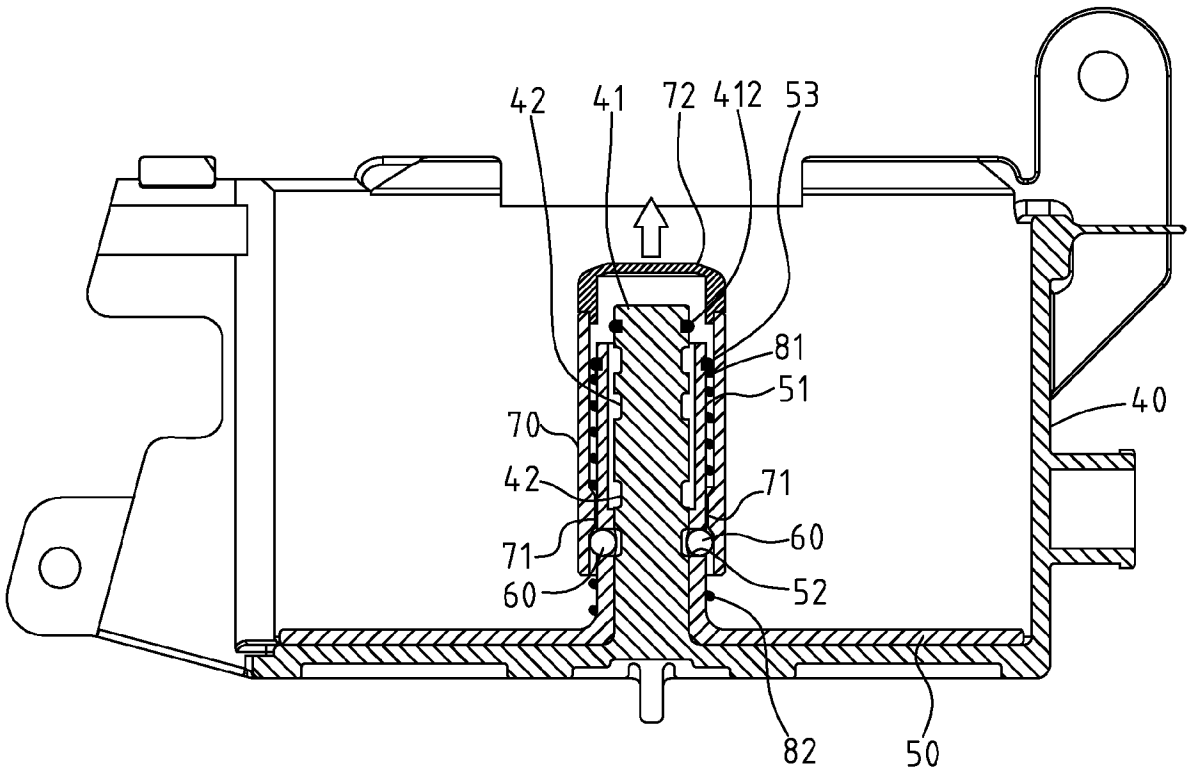
FIGS. 7–9 show the adjustable operating sectional views of the nail tray of the present invention.

As shown in FIG. 7, when the nail tray 50 needs to be adjusted, the user can hold on to the braking tube 70 and pull it upward, and by so doing, it moves the balance block 71 up at the same time to take care of the pushing of the positioning bead 60, and the user can release the position of the nail tray 50.

Figure 8:
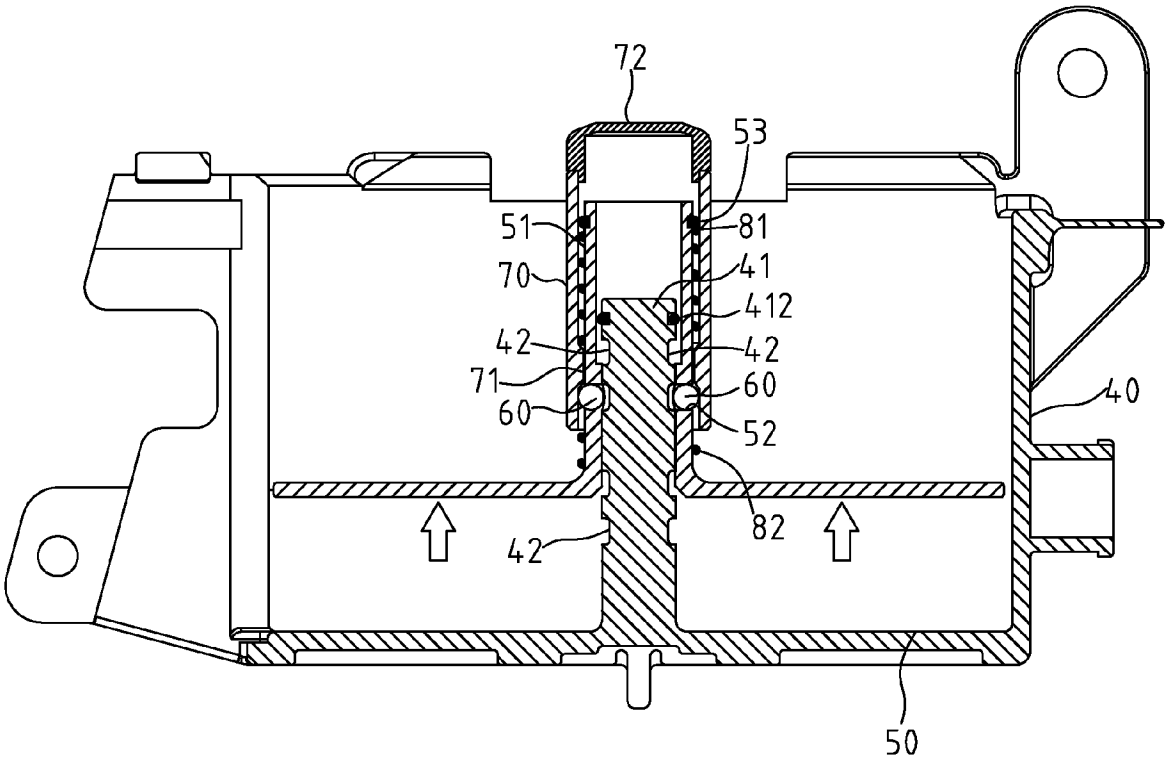
Figure 9:
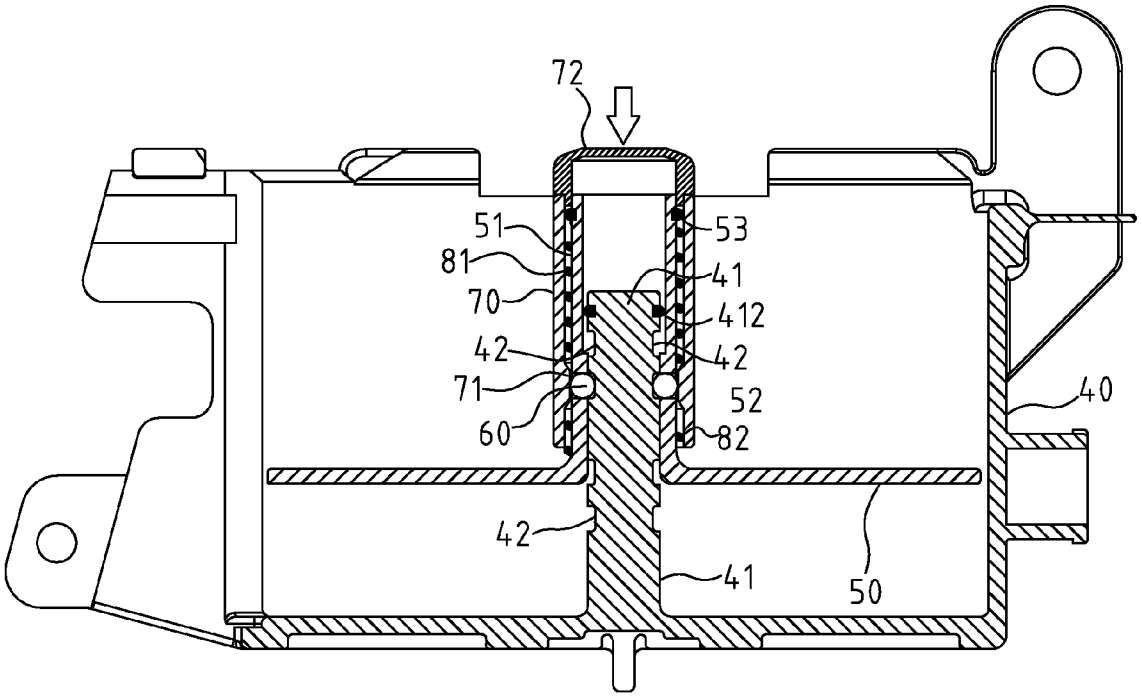
Figure 10:
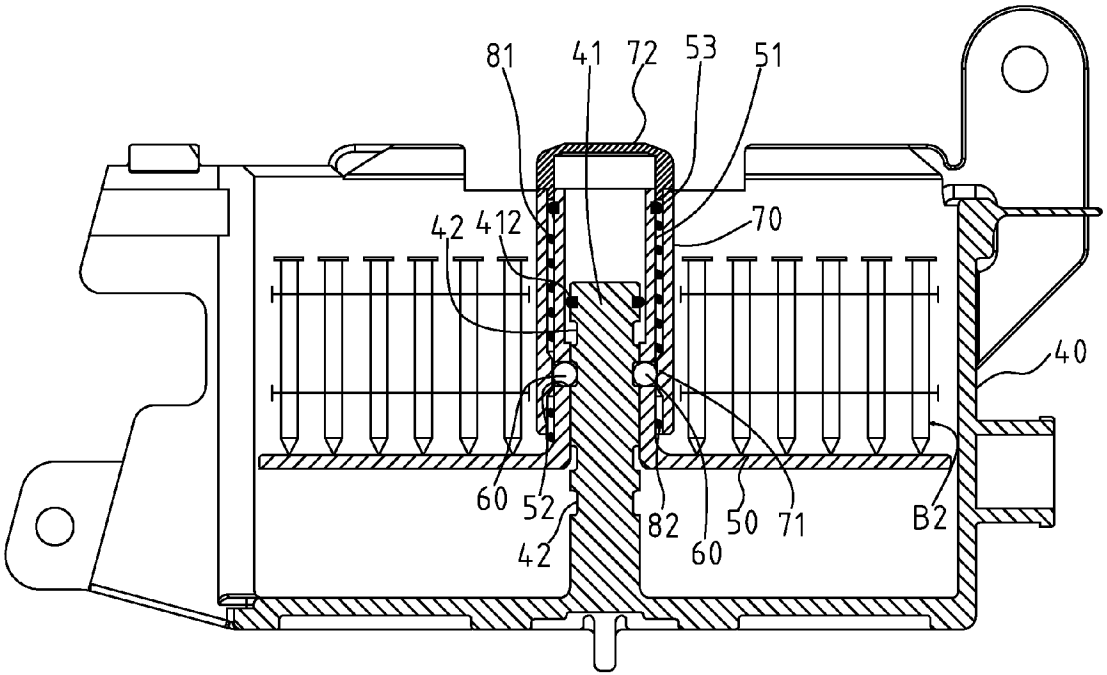
FIG. 10 shows the sectional view of the complete positioning of the nail tray of the present invention.

As shown in FIG. 8 as the follow-up of the above, the top of the elastic component 81 is blocked by the limit component 53 of the vertical sleeve 51, and the bottom is blocked at the balance block 71 of the braking tube 70. Therefore, when the user is pulling the braking tube 70 upwards, it will lift the vertical sleeve 51 up along with the nail tray 50. Meanwhile, the upper elastic component 81 will be pressed and accumulate elastic force, then, when the positioning bead 60 reaches another positioning slot 42, it releases braking tube 70. At this time, the braking tube 70 is restored by the releasing force of the elastic component 81 and makes the balance block 71 restore to the corresponding position of the positioning through hole 52, and pushes the positioning bead 60 inwards to be locked the place between the central column 41 and the positioning slot 42. By so doing it moves the nail tray 50 up to another height; under this condition, the nail tray 50 can be placed with nail coil B2 that is smaller.

As the follow-up of FIG. 8, when the user desires to lower the nail tray 50, again, it pulls up the braking tube 70 to take care the pushing condition of the positioning bead 60, so that the position of the nail tray 50 can be released. At this time, the user pushes the nail tray down with another hand to achieve the height of the next gear, which releases the braking tube 70 to achieve the positioning status.

Figure 11:
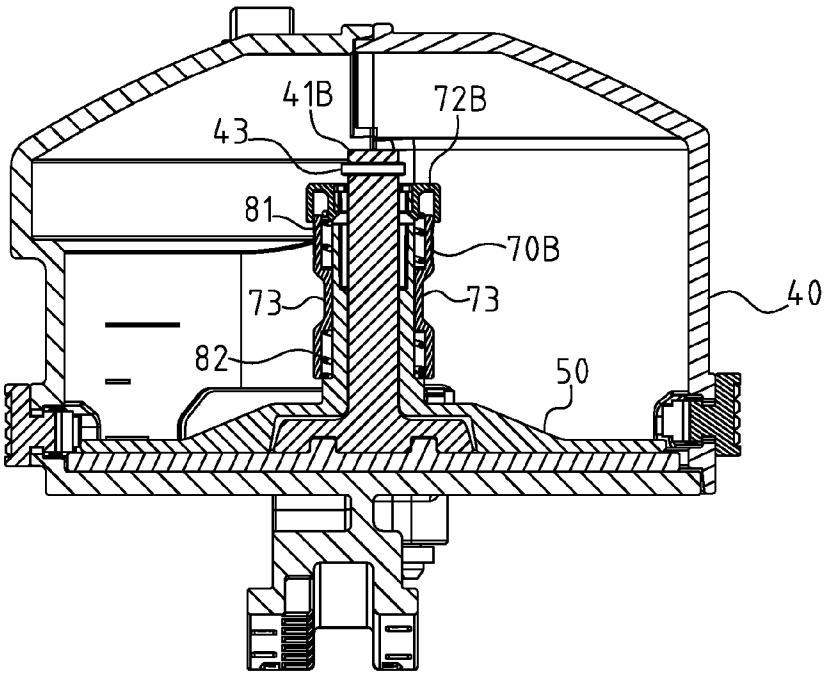
FIG. 11 shows the cross-sectional view another embodiment of the hoist structure of the nail tray.
Figure 12:
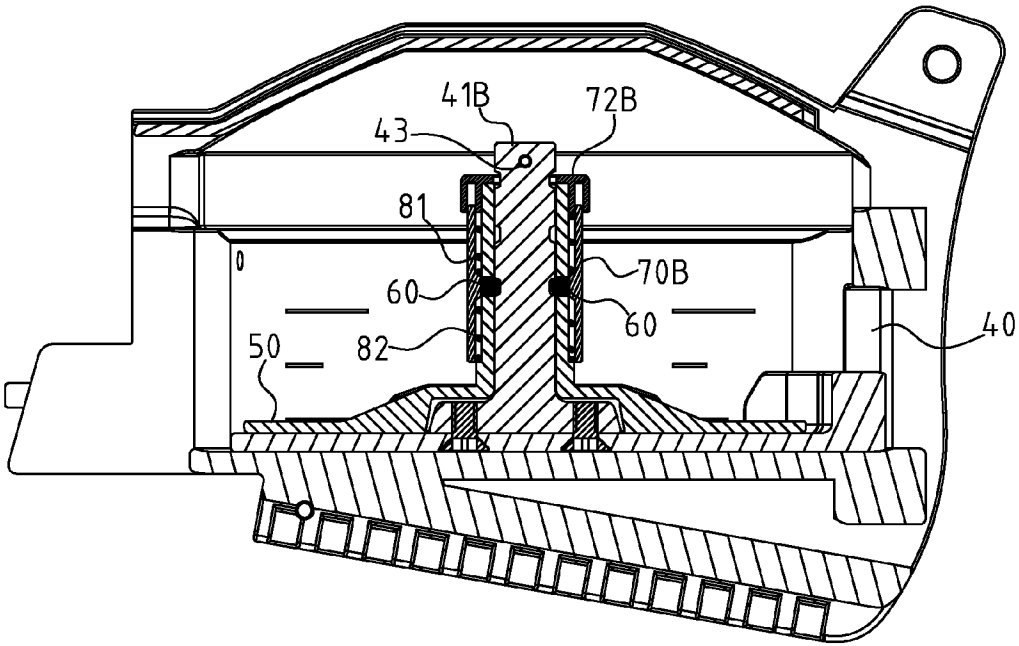
FIG. 12 shows the cross-sectional view of FIG. 11 from another side.

FIGS. 11 and 12 show the cross-sectional view of another embodiment of the hoist structure of the nail tray. It differs from the prior embodiment for the limiting method of the vertical sleeve 51B, whereas as the top of its central column 41B goes through the casing 72B and then through a peg column (43), which has two protruding ends so that the peg column (43) could make the vertical sleeve 51B, casing 72B, and braking tube 70B moving upward for stopping and limiting. Another feature is that the peripheral of the braking tube 70B has a concave rim 73, which allows the user to hold more steadily and slip-free.

We claim:

1. A nail tray hoist apparatus comprising:

a coil nail base having a central column extending upwardly therefrom, said central column having a plurality of positioning slots extending therearound in spaced and separate relation to each other;

a nail tray having a vertical sleeve extending upwardly therefrom, said vertical sleeve slidably positioned over said central column such that said nail tray overlies said coil nail base, said vertical sleeve having at least one through hole formed through a wall of said sleeve;

at least one positioning bead received in the through hole of said vertical sleeve and selectively engageable with one of said plurality of positioning slots on said central column;

a braking tube slidably positioned over an exterior of said vertical sleeve of said nail tray, said braking tube having a balance block extending inwardly from an inner wall of said braking tube, said balance block selectively contacting the positioning bead so as to fix the positioning bead within the positioning slot of said central column; and at least one elastic member extending around said vertical sleeve and interior of said inner wall of said braking tube, said elastic member urging said braking tube to a position in which said balance block contacts said positioning bead.

2. The apparatus of claim 1, said braking tube being slidable with respect to said vertical sleeve against the urging of the elastic member such that said balance block releases from said positioning bead so as to allow said vertical sleeve of said nail tray to move to another of said plurality of positioning slots.

3. The apparatus of claim 1, further comprising:

a limit component affixed adjacent to a top of said vertical sleeve, said limit component contacting a top of the elastic member, the elastic member having a bottom contacting said balance block.

4. The apparatus of claim 3, further comprising:

another elastic member positioned between said braking tube and said vertical sleeve, said another elastic member having a top contacting said balance block.

5. The apparatus of claim 3, said limit component being a buckle.

6. The apparatus of claim 1, said balance block being an annular protruding surface extending inwardly from said inner wall of said braking tube.

* * * * *